US011691867B2

(12) United States Patent
Rodgers

(10) Patent No.: US 11,691,867 B2
(45) Date of Patent: Jul. 4, 2023

(54) MULTI-LENGTH TUFT FEEDER

(71) Applicant: Paul Rodgers, Bacup (GB)

(72) Inventor: Paul Rodgers, Bacup (GB)

(73) Assignees: Paul Rodgers, Bacup (GB); David Trickett, Bacup (GB)

( * ) Notice: Subject to any disclaimer, the term of this patent is extended or adjusted under 35 U.S.C. 154(b) by 738 days.

(21) Appl. No.: 16/759,470

(22) PCT Filed: Oct. 16, 2018

(86) PCT No.: PCT/GB2018/052980
§ 371 (c)(1),
(2) Date: Apr. 27, 2020

(87) PCT Pub. No.: WO2019/086834
PCT Pub. Date: May 9, 2019

(65) Prior Publication Data

US 2020/0283285 A1 Sep. 10, 2020

(30) Foreign Application Priority Data

Oct. 31, 2017 (GB) ..... 1717998

(51) Int. Cl.
*B68G 7/08* (2006.01)
*B68G 15/00* (2006.01)
(Continued)

(52) U.S. Cl.
CPC ..... *B68G 7/08* (2013.01); *B68G 15/00* (2013.01); *D05C 15/04* (2013.01); *D05C 15/08* (2013.01);
(Continued)

(58) Field of Classification Search
CPC ..... D05C 15/00; D05C 15/08; Y10T 29/484; Y10T 24/3645; B68G 7/08
See application file for complete search history.

(56) References Cited

U.S. PATENT DOCUMENTS 1,998,418 A * 4/1935 Fridolph ..... D05C 15/20 223/102
2,089,252 A * 8/1937 Droll ..... B68G 7/08 112/2.2
(Continued)

FOREIGN PATENT DOCUMENTS

EP 1167279 1/2002
EP 1474354 8/2003

OTHER PUBLICATIONS

PCT Search Report from PCT/GB2018/052980 dated Dec. 20, 2018.

*Primary Examiner* — Michael W Hotchkiss
(74) *Attorney, Agent, or Firm* — Woodard, Emhardt, Henry, Reeves & Wagner, LLP

(57) ABSTRACT

Upholstery tufting apparatus comprises an insertion needle (5) with an aperture (4) to receive a tuft for insertion into an article to be upholstered. The tuft is presented to the needle aperture (4) along a tuft feed axis (3). The apparatus has a plurality of tuft strings (2*a*, 2*b*, 2*c*), a first string (2*a*) with tufts of a first length and a second string (2*b*) with tufts of different second length. The apparatus has one or more tuft feed units, and an actuator operatively connected to said tuft feed unit(s). The first and second tuft strings (2*a*, 2*b*) are associated with the tuft feed unit(s). A selected one of the tuft feed unit(s) is actuatable by the actuator to align one of the first and second strings (2*a*, 2*b*) with the tuft feed axis (3) according to the length of tuft required to be inserted into an article to be upholstered. A method for tufting an upholstered article employing said apparatus is also described.

18 Claims, 3 Drawing Sheets

(51) Int. Cl.
*D05C 15/04* (2006.01)
*D05C 15/08* (2006.01)

(52) U.S. Cl.
CPC ..... *D10B 2505/08* (2013.01); *Y10T 24/3645* (2015.01)

(56) References Cited

U.S. PATENT DOCUMENTS 2,192,161 A * 2/1940 Fridolph ..... B68G 7/08 223/103
2,785,644 A * 3/1957 Freedle ..... B68G 7/085 112/223
2,920,588 A * 1/1960 Bronstien, Jr. ..... B68G 7/08 192/127
3,875,883 A * 4/1975 Eberwein ..... B65H 57/12 112/475.08
3,894,666 A * 7/1975 Delahousse ..... B68G 7/085 223/102
3,943,865 A * 3/1976 Short ..... D05C 15/32 112/80.24
4,244,309 A * 1/1981 Spanel ..... D05C 15/20 112/80.4
4,549,496 A * 10/1985 Kile ..... D05C 15/34 112/80.08
4,991,523 A * 2/1991 Ingram ..... D05C 15/24 112/80.08
5,267,520 A * 12/1993 Ingram ..... D05C 15/28 112/410
5,309,612 A 5/1994 Briere et al.
5,531,392 A * 7/1996 Weiner ..... D04B 15/42 242/157 R
6,032,345 A * 3/2000 Resta ..... B68G 15/005 29/91.2
6,273,011 B1 * 8/2001 Amos ..... D05C 15/34 112/222
6,634,307 B2 * 10/2003 Resta ..... B68G 7/08 29/91.4
6,718,894 B2 * 4/2004 Whaley ..... B68G 15/005 112/113
6,804,940 B2 * 10/2004 Resta ..... B68G 7/08 53/524
7,191,716 B2 * 3/2007 Dixon ..... B68G 7/08 112/80.01
7,506,831 B1 * 3/2009 Weiner ..... D05C 15/18 242/157 R
8,141,505 B2 * 3/2012 Hall ..... D05C 15/34 112/80.23
10,961,647 B2 * 3/2021 Amos ..... D05C 17/026
2011/0203506 A1 * 8/2011 Price ..... D05C 15/26 112/475.08

* cited by examiner

MULTI-LENGTH TUFT FEEDER

The present invention relates to an automatic upholstery tufting method and apparatus therefor, particularly but not exclusively, for tufting such articles as mattresses, cushions and the like. Tufting is widely used to support and strengthen upholstered articles, such as mattresses.

Tufting typically involves the insertion of an elongate flexible element such as a tape or string interconnecting a pair of toggles (the whole hereinafter referred to as a "tuft") through a mattress so that one toggle resides on either side of the mattress. The mattress is usually compressed during insertion of the tuft and allowed to expand once the tufting process has been completed.

The tufting process is often carried out using an automatic tufting apparatus. European Patent No. EP1167279 discloses a device and method for automatically tufting upholstery. The device comprises an engagement means, a separating means and a driving means for driving one tuft from a plurality of tufts through an upholstery unit. European Patent No. EP1474354 discloses an automatic tufting method and apparatus therefor. The apparatus comprises three main constituent units: a tuft feed unit, a washer feed unit and an insertion needle. The tuft feed unit feeds and inserts individual tufts from a string of tufts into the insertion needle.

The length of the tuft is marginally less than the depth of the mattress; therefore the region of the mattress near the tuft remains slightly compressed following expansion of the mattress after insertion. As mattresses are available in varying depths, different lengths of tufts are required. In the use of current automatic tufting devices it is a laborious task to reset the tufting apparatus to function with a different length of tuft, whether this is by changing the plurality of tufts fed into the apparatus, or adjusting mechanical settings.

An object of the present invention is therefore to provide an efficient tufting apparatus that is capable of selectively inserting tufts of different lengths according to the depth of the mattress.

According to a first aspect of the invention an upholstery tufting apparatus comprises an insertion needle. The insertion needle comprises an aperture to receive a tuft for insertion into an article to be upholstered. In use, the tuft is presented to the aperture of the insertion needle along a tuft feed axis. The upholstery tufting apparatus further comprises a plurality of tuft strings. A first tuft string comprises a plurality of tufts of a first length. A second tuft string comprises a plurality of tufts wherein each tuft is a second length which is different to said first length. The upholstery tufting apparatus further comprises one or more tuft feed units. The upholstery tufting apparatus further comprises an actuator connected to said one or more tuft feed units. The first tuft string and the second tuft string are associated with said one or more tuft feed units. A selected one of said one or more tuft feed units is actuatable by the actuator to align one of the first and second tuft strings with the tuft feed axis according to the length of tuft required, in use, to be inserted into an article to be upholstered.

In a preferred embodiment, there may be provided a plurality of tuft feed units. A first tuft feed unit of said plurality of tuft feed units may be associated with the first tuft string. A second tuft feed unit of said plurality of tuft feed units may be associated with the second tuft string.

In a further embodiment the plurality of tuft feed units may be arranged in a linear array. The actuator may be operated, in use, to move the linear array of tuft feed units so as to align the tuft feed string associated with the selected one of the plurality of tuft feed units with the tuft feed axis. The actuator may be operated, in use, to move the selected one of the plurality of tuft feed units so as to align the tuft feed string associated with said selected one of the plurality of tuft feed units with the tuft feed axis.

In a further embodiment the plurality of tuft feed units may be arranged in an array around the tuft feed axis. The actuator may be operated, in use, to move the selected one of the plurality of tuft feed units to align the tuft feed string associated with said selected one of the plurality of tuft feed units with the tuft feed axis.

In a further preferred embodiment the plurality of tuft feed units may be arranged in a circular array around the tuft feed axis. The actuator may be operated, in use, to move the selected one of the plurality of tuft feed units in a radial direction to align the tuft feed string associated with said selected one of the plurality of tuft feed units with the tuft feed axis.

In a further embodiment the plurality of tuft feed units may be arranged in a circular array centred on an axis which is offset from said tuft feed axis and which extends parallel to the tuft feed axis. The tuft feed axis may be aligned with a point on a circle defined by said circular array. The actuator may be operated, in use, to rotate the circular array of tuft feed units so as to align the tuft feed string associated with the selected one of the plurality of tuft feed units with the tuft feed axis.

In a further preferred embodiment, the or each of said one or more tuft feed units may comprise a rodless air cylinder.

In a further embodiment the actuator may be a pneumatic actuator.

In a further embodiment the upholstery tufting apparatus may further comprise a selector and a controller. The selector may determine the length of tuft required for insertion into said article to be upholstered. The selector may select an output according to the determined length of tuft required. The controller may control the actuator according to the output of the selector. The controller may be a servo controller.

A second aspect of the invention provides a method for tufting an upholstered article using apparatus of the first aspect of the invention comprises the step of operating a selector to select the length of tuft required to be inserted into the upholstered article. The method further comprises the step of operating a controller to control the actuator, according to the length of tuft selected by the selector, to move said selected one of said one or more tuft feed units to align said one of the first and second tuft string with the tuft feed axis according to the selected length of tuft to be inserted into the article to be upholstered. The method further comprises the step of operating the tuft insertion needle to insert the tuft of the selected length into the upholstered article.

Any of the optional features of the apparatus according to the first aspect of the present invention may be employed in the method according to the second aspect of the invention.

According to a third aspect of the invention an upholstery tufting apparatus comprises an insertion needle. The insertion needle comprises an aperture to receive a tuft for insertion into an article to be upholstered. In use, the tuft is presented to the aperture of the insertion needle along a tuft feed axis. The upholstery tufting apparatus further comprises a plurality of tuft strings. A first tuft string comprises a plurality of tufts of a first length. A second tuft string comprises a plurality of tufts of a second length. The upholstery tufting apparatus further comprises one or more tuft feed units. The upholstery tufting apparatus further comprises an actuator operatively connected to the insertion needle. The first tuft string and the second tuft string are associated with said one or more tuft feed units. The insertion needle is actuatable by the actuator to align the tuft feed axis with a selected one of the first and second tuft strings according to the length of tuft required, in use, to be inserted into an article to be upholstered.

Where technically feasible, any of the optional features of the apparatus according to the first aspect of the present invention may be employed in the apparatus according to the third aspect of the invention.

A fourth aspect of the invention provides a method for tufting an upholstered article using apparatus according to the third aspect of the invention comprises the step of operating a selector to select the length of tuft required to be inserted into the upholstered article. The method further comprises the step of operating a controller to control the actuator, according to the length of tuft selected by the selector, to move said insertion needle to align the tuft feed axis with the selected one of the first and second tuft strings according to the selected length of tuft to be inserted into the article to be upholstered. The method further comprises the step of operating the tuft insertion needle to insert the tuft of the selected length into the upholstered article.

Where technically feasible, any of the optional features of the apparatus according to the first aspect of the present invention may be employed in the method according to the fourth aspect of the invention.

Embodiments of the present invention will now be described, by way of example only, with reference to the accompanying drawings in which.

Figure 3A:
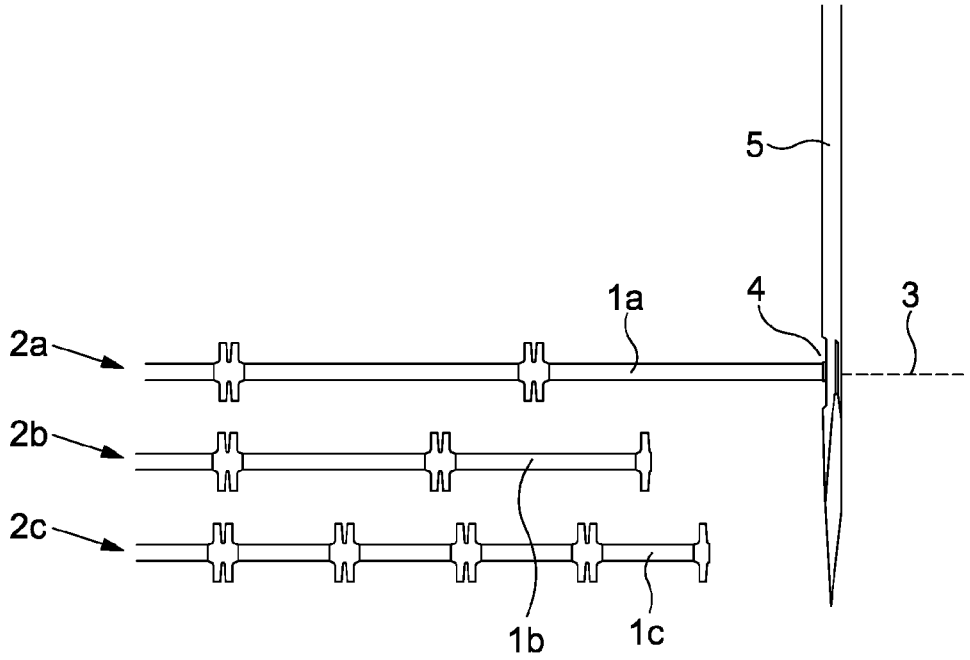
Figure 3B:
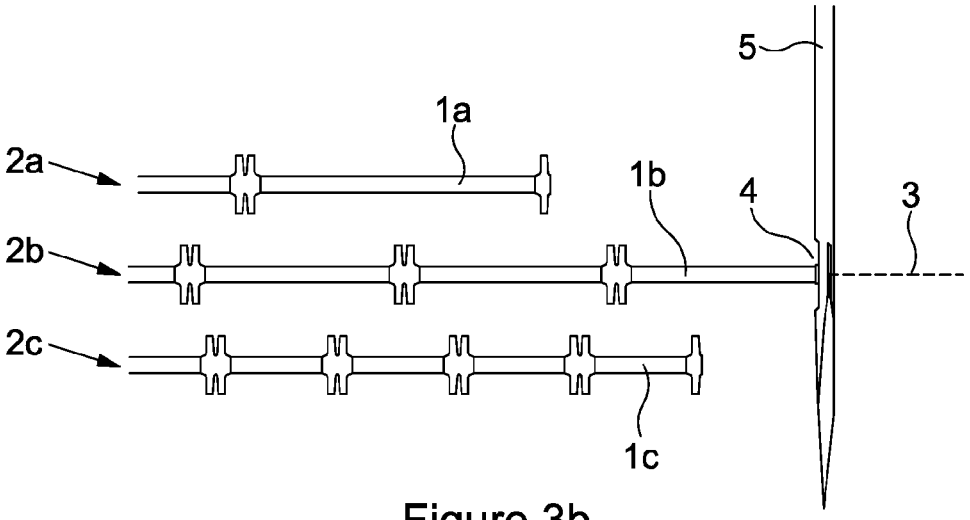
Figure 4:
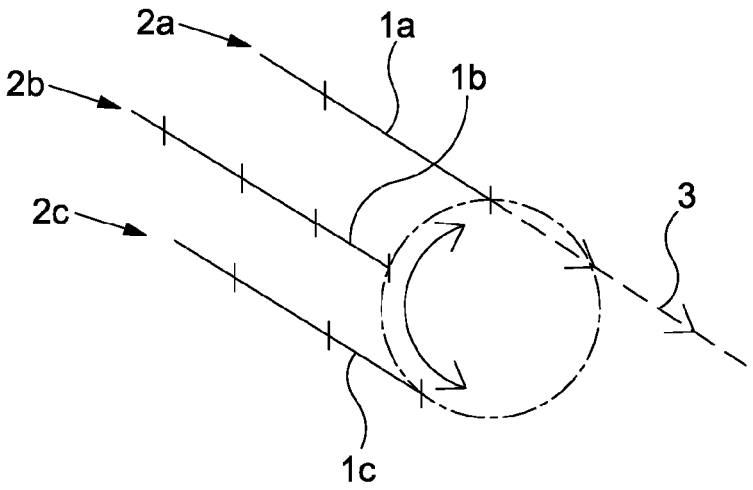
Figure 5:
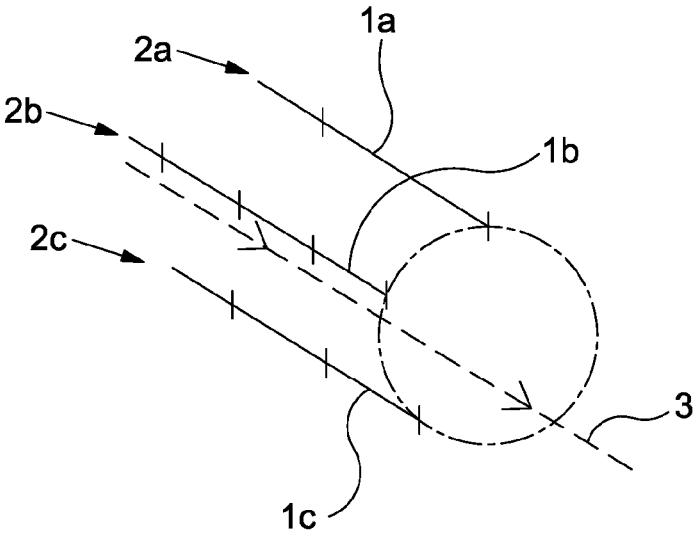

FIGS. 3*a* and 3*b* are schematic side views of multiple strings of different length tufts adjacent a tuft insertion needle wherein the tuft strings extend parallel to one another;

FIG. 4 is a schematic view of multiple strings of different length tufts wherein the tuft strings are arranged around a circumference and a tuft feed axis intersects the circumference; and FIG. 5 is a schematic view of multiple strings of different length tufts wherein the tuft strings are arranged circumferentially around a tuft feed axis.

Figure 1:
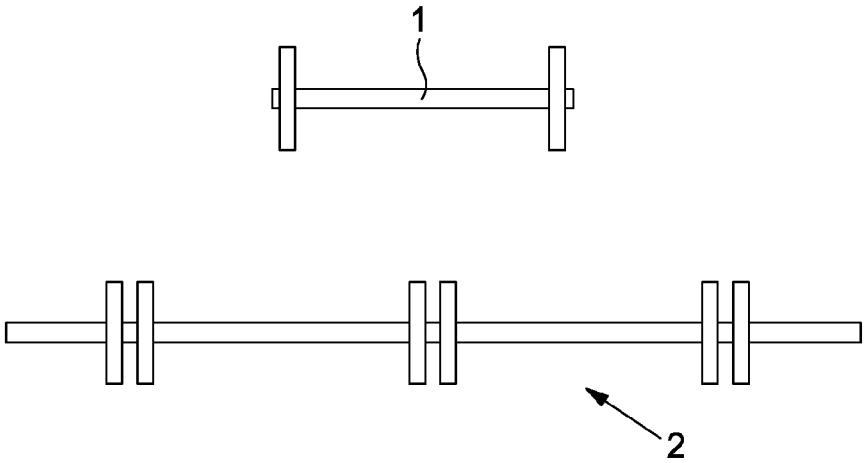
FIG. 1 is a plan view of a single tuft and a plurality of connected tufts to be used with apparatus of the present invention.
Figure 2:
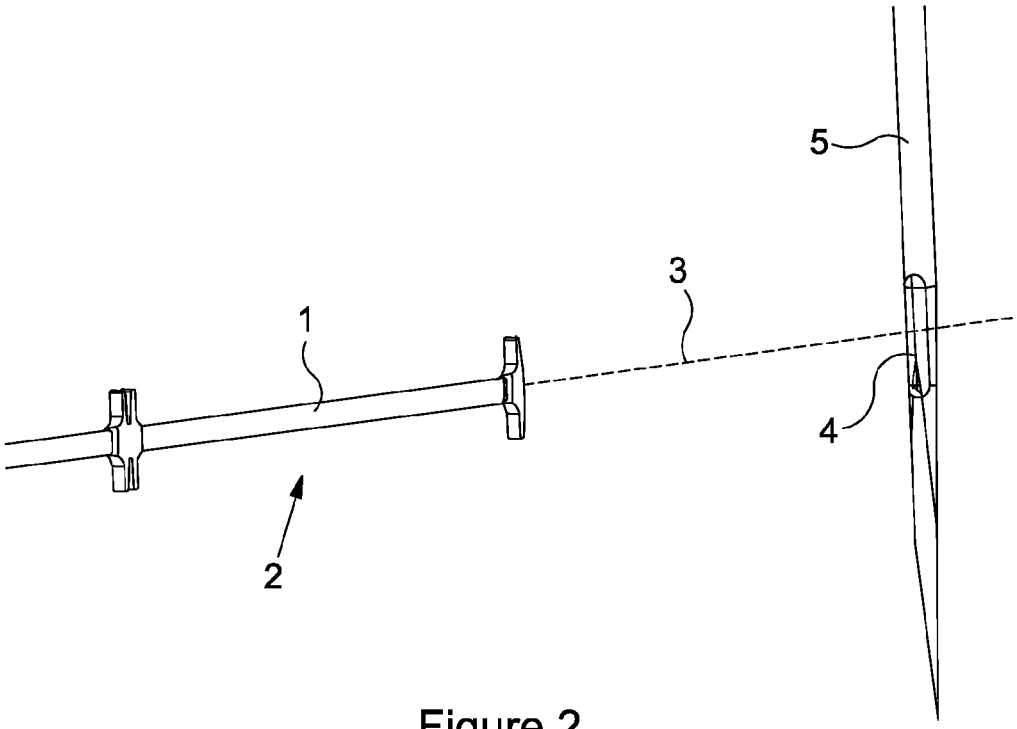
FIG. 2 is a schematic view of a string of tufts aligned with an aperture defined by a tuft insertion needle to define a tuft feed axis.

Apparatus according to a first embodiment of the present invention comprises a plurality of tuft feed units and an insertion needle which interact to insert a tuft of a required length, into a mattress. A tuft feed unit is aligned so as to insert an individual tuft 1 from a tuft string 2 (see FIG. 1) along a tuft feed axis 3 and into an aperture 4 of the insertion needle 5 (see FIG. 2). An exemplary tuft feed unit is described in European Patent No. EP1474354. Alternatively, a tuft feed unit may be a rodless air cylinder, or any other suitable unit. The insertion needle 5 then inserts the tuft 1 into the mattress (downwardly in the arrangement shown in FIG. 2, although any orientation is possible).

Referring to FIGS. 3*a* and 3*b*, the apparatus of the present invention is designed to enable a tuft 1*a*, 1*b*, 1*c* of the required length to be selected from a plurality of tuft strings 2*a*, 2*b*, 2*c*, respectively for locating in the aperture 4 of an insertion needle 5. Each tuft string 2*a*, 2*b*, 2*c* comprises tufts 1*a*, 1*b*, 1*c* respectively of a different length to the tufts 1*a*, 1*b*, 1*c* of another tuft string 2*a*, 2*b*, 2*c*. In this embodiment, each tuft string 2*a*, 2*b*, 2*c* is fed into a dedicated tuft feed unit (not shown). That is, a plurality of tufts 1*a* of a first length form a first tuft string 2*a*, wherein the first tuft string 2*a* is fed into a first tuft feed unit (not shown) and a plurality of tufts 1*b* of a second length form a second tuft string 2*b*, the second tuft string 2*b* being fed into a second tuft feed unit. The same arrangement is used in respect of a third tuft string 3*c* made up of a plurality of tufts 1*c*. While three tuft strings are shown, any number can be utilised with the apparatus and method of the present invention.

The plurality of tuft feed units is actuated to selectively align one of the plurality of tuft feed units with the tuft feed axis 3 to enable a required length of tuft 1 to be inserted into the aperture 4 of the insertion needle 5. The required length of tuft 1 is determined according to the depth of the mattress to be tufted and the desired residual tension in the mattress at the point at which the tuft is inserted. In this embodiment, the insertion needle 5 remains stationary as the plurality of tuft feed units supporting the tuft strings 2 are actuated so that tufts of the correct length can be fed to the insertion needle 5. The selection and actuation of the appropriate tuft feed unit may be achieved pneumatically, hydraulically, electrically or by any other suitable means. The actuator may be controlled by a servo, or by any other suitable means.

In one embodiment, the plurality of tuft feed units are arranged so that the tuft strings extend parallel to one another and the selection of the appropriate tuft feed unit occurs by linear movement of the tuft feed units as described below. The tuft feed units may be arranged vertically, horizontally, or otherwise. In a first position, shown in FIG. 3*a*, the first tuft feed unit is orientated so that the first tuft string 2*a* is aligned with the tuft feed axis 3. When it is desired to insert a different length tuft (shorter in the embodiment shown in FIGS. 3*a* and 3*b*), the actuator causes the first tuft feed unit to move the first tuft string 2*a* linearly upwards out of alignment with the tuft feed axis 3. The actuator then moves the second tuft feed unit linearly upwards to bring the second tuft string 2*b* into alignment with the tuft feed axis 3, as shown in FIG. 3*b*.

In another embodiment shown in FIG. 4, a plurality of tuft feed units (not shown) are arranged circumferentially around an arbitrary axis (not marked on FIG. 4). A tuft feed axis 3 is aligned with a point on the circumference on which the plurality of tuft feed units are arranged. In a first position, the first tuft feed unit orientated so that the first tuft string 2*a* is aligned with the tuft feed axis 3. When it is desired to insert a different length tuft, the actuator (not shown) rotates the plurality of tuft feed units around the arbitrary axis, i.e. along the aforementioned circumference, so that movement of the first tuft feed unit causes the first tuft string 2*a* to move out of alignment with the tuft feed axis 3 and the second tuft feed unit moves to bring a second tuft string 2*b* in to alignment with the tuft feed axis 3 ready for insertion into an aperture in an insertion needle (not shown).

In another embodiment shown in FIG. 5, the tuft feed units (not shown) are arranged radially around a tuft feed axis 3. In a first position, a first tuft feed unit is orientated so that the first tuft string 2*a* is aligned with the tuft feed axis 3. When it is desired to insert a different length tuft, the actuator (not shown) moves the first tuft feed unit radially outward, to move the first tuft string 2*a* out of alignment with the tuft feed axis 3, and the actuator then moves a second tuft feed unit radially inward to bring the second tuft string 2*b* into alignment with the tuft feed axis 3 ready for insertion into an aperture in an insertion needle (not shown).

In each of the aforementioned embodiments, the second (or subsequent) tuft feed unit is selected and aligned with the tuft feed axis 3 by the actuator according to the length of tuft required to be inserted according to the depth of the mattress (or region of the mattress) to be tufted.

In an alternative embodiment, the actuator is used to move the insertion needle 5 to different positions relative to the plurality of tuft feed units, thereby aligning the tuft feed axis 3 with the selected tuft feed unit, i.e. the plurality of tuft feed units remains stationary as the insertion needle 5 is move by the actuator. In a first position, the tuft feed axis 3 is aligned with a first of the plurality of tuft feed units. The insertion needle 5 then moves to a second (or subsequent) position wherein the tuft feed axis 3 is aligned with a second (or subsequent) tuft feed unit supporting tufts of a different length. The second (or subsequent) position will be selected as required according to the length of tuft required for the mattress (or region of mattress) to be tufted. By way of example, the insertion needle 5 may be suspended from a gantry and moved around said gantry to change position relative to the tuft feed units.

The process of selecting the required length of tuft for the mattress being tufted is carried out by a selector. The selector may be automatic, for example a reader to read a product identification on a mattress to be tufted, such as a barcode or radio frequency (RF) chip. Alternatively, the selector may be a manual operation wherein an operator may select the length of tuft required based on the identification of the mattress to be tufted. The selector may be a pre-programmed selector that selects the length of tuft required according to a manually selected pre-programmed tuft pattern. A controller will control the actuator according to the output of the selector.

It will be appreciated that it may be desired to insert tufts of a single length into a mattress or it may be desirable to insert tufts of different lengths into the same mattress, for example, to define regions of the mattress with greater or lesser tension and thereby firmness.

The invention claimed is:

1. An upholstery tufting apparatus comprising:

an insertion needle comprising an aperture to receive a tuft for insertion into an article to be upholstered, wherein, in use, the tuft is presented to the aperture of the insertion needle along a tuft feed axis, a plurality of tuft strings including a first tuft string comprising a plurality of tufts of a first length and a second tuft string comprising a plurality of tufts of a second length which is different to said first length, one or more tuft feed units, and an actuator operatively connected to said one or more tuft feed units;

wherein the first tuft string and the second tuft string are associated with said one or more tuft feed units; and wherein a selected one of said one or more tuft feed units is actuatable by the actuator to align one of the first and second tuft strings with the tuft feed axis according to the length of tuft required, in use, to be inserted into the article to be upholstered.

2. An upholstery tufting apparatus according to claim 1 wherein the or each of said one or more tuft feed units comprises a rodless air cylinder.

3. An upholstery tufting apparatus according to claim 1 wherein the actuator is a pneumatic actuator.

4. An upholstery tufting apparatus according to claim 1 further comprising a selector and a controller, wherein the selector determines the length of tuft required for insertion into said article to be upholstered and selects an output according to the determined length of tuft required, and the controller controls the actuator according to the output of the selector.

5. An upholstery tufting apparatus according to claim 4 wherein the controller is a servo controller.

6. An upholstery tufting apparatus according to claim 1 wherein there is provided a plurality of tuft feed units, a first tuft feed unit of said plurality of tuft feed units associated with the first tuft string and a second tuft feed unit of said plurality of tuft feed units associated with the second tuft string.

7. An upholstery tufting apparatus according to claim 6 wherein the plurality of tuft feed units are arranged in an array around the tuft feed axis.

8. An upholstery tufting apparatus according to claim 7 wherein the actuator is operated, in use, to move the selected one of the plurality of tuft feed units to align the tuft feed string associated with said selected one of the plurality of tuft feed units with the tuft feed axis.

9. An upholstery tufting apparatus according to claim 6 wherein the plurality of tuft feed units are arranged in a circular array around the tuft feed axis.

10. An upholstery tufting apparatus according to claim 9 wherein the actuator is operated, in use, to move the selected one of the plurality of tuft feed units in a radial direction to align the tuft feed string associated with said selected one of the plurality of tuft feed units with the tuft feed axis.

11. An upholstery tufting apparatus according to claim 6 wherein the plurality of tuft feed units are arranged in a circular array centred on an axis which is offset from said tuft feed axis and which extends parallel to the tuft feed axis, the tuft feed axis being aligned with a point on a circle defined by said circular array.

12. An upholstery tufting apparatus according to claim 11 wherein the actuator is operated, in use, to rotate the circular array of tuft feed units so as to align the tuft feed string associated with the selected one of the plurality of tuft feed units with the tuft feed axis.

13. An upholstery tufting apparatus according to claim 6 wherein the plurality of tuft feed units are arranged in a linear array.

14. An upholstery tufting apparatus according to claim 13 wherein the actuator is operated, in use, to move the linear array of tuft feed units so as to align the tuft feed string associated with the selected one of the plurality of tuft feed units with the tuft feed axis.

15. An upholstery tufting apparatus according to claim 13 wherein the actuator is operated, in use, to move the selected one of the plurality of tuft feed units so as to align the tuft feed string associated with said selected one of the plurality of tuft feed units with the tuft feed axis.

16. A method for tufting an upholstered article using apparatus according to claim 1, wherein the method comprises the steps of:

operating a selector to select the length of tuft required to be inserted into the upholstered article;

operating a controller to control the actuator, according to the length of tuft selected by the selector, to move said selected one of said one or more tuft feed units to align said one of the first and second tuft strings with the tuft feed axis according to the selected length of tuft to be inserted into the article to be upholstered; and operating the tuft insertion needle to insert the tuft of the selected length into the upholstered article.

17. An upholstery tufting apparatus comprising: an insertion needle comprising an aperture to receive a tuft for insertion into an article to be upholstered, wherein, in use, the tuft is presented to the aperture of the insertion needle along a tuft feed axis, a plurality of tuft strings including a first tuft string comprising a plurality of tufts of a first length and a second tuft string comprising a plurality of tufts of a second length which is different to said first length, one or more tuft feed units, and an actuator operatively connected to the insertion needle; wherein the first tuft string and the second tuft string are associated with said one or more tuft feed units; and wherein the insertion needle is actuatable by the actuator to align the tuft feed axis with a selected one of the first and second tuft strings according to the length of tuft required, in use, to be inserted into the article to be upholstered.

18. A method for tufting an upholstered article using apparatus according to claim 17, wherein the method comprises the steps of:

operating a selector to select the length of tuft required to be inserted into the upholstered article;

operating a controller to control the actuator, according to the length of tuft selected by the selector, to move said insertion needle to align the tuft feed axis with the selected one of the first and second tuft strings according to the selected length of tuft to be inserted into the article to be upholstered; and operating the tuft insertion needle to insert the tuft of the selected length into the upholstered article.

* * * * *